United States Patent [19]

Beistegui

[11] Patent Number: 4,809,970

[45] Date of Patent: Mar. 7, 1989

[54] INERTIA MECHANISM IN GYMNASTIC BICYCLES OR THE LIKE

[75] Inventor: Jose L. Beistegui, Vitoria Alava, Spain

[73] Assignee: B. H. Holdings Limited, Jersey, Channel Islands

[21] Appl. No.: 155,236

[22] Filed: Feb. 12, 1988

[30] Foreign Application Priority Data

Feb. 20, 1987 [ES] Spain ..... 8700439

[51] Int. Cl.[4] ..... A63B 21/00; G05G 1/00

[52] U.S. Cl. ..... 272/73; 74/572

[58] Field of Search ..... 272/72, 73, 93, 128; 74/572

[56] References Cited

U.S. PATENT DOCUMENTS

| | | | |
|---|---|---|---|
| 3,578,800 | 5/1971 | DiNepi | 272/73 |
| 4,647,036 | 3/1987 | Huszczuk | 272/73 |
| 4,676,121 | 6/1987 | Kouno | 74/572 |

*Primary Examiner*—Richard J. Apley
*Assistant Examiner*—S. R. Crow
*Attorney, Agent, or Firm*—Helfgott & Karas

[57] ABSTRACT

An inertia mechanism for gymnastic bicycles having a pedalling axle, the mechanism includes an inertia flywheel and a set of cogged crowns of different diameters and different number of cogs mounted on the flywheel and operatively connected to each other and to the pedalling axle so that weight and the size reduction of the flywheel are counterbalanced by the set of the cogged crowns actuated upon the actuation of the pedalling axle.

3 Claims, 1 Drawing Sheet

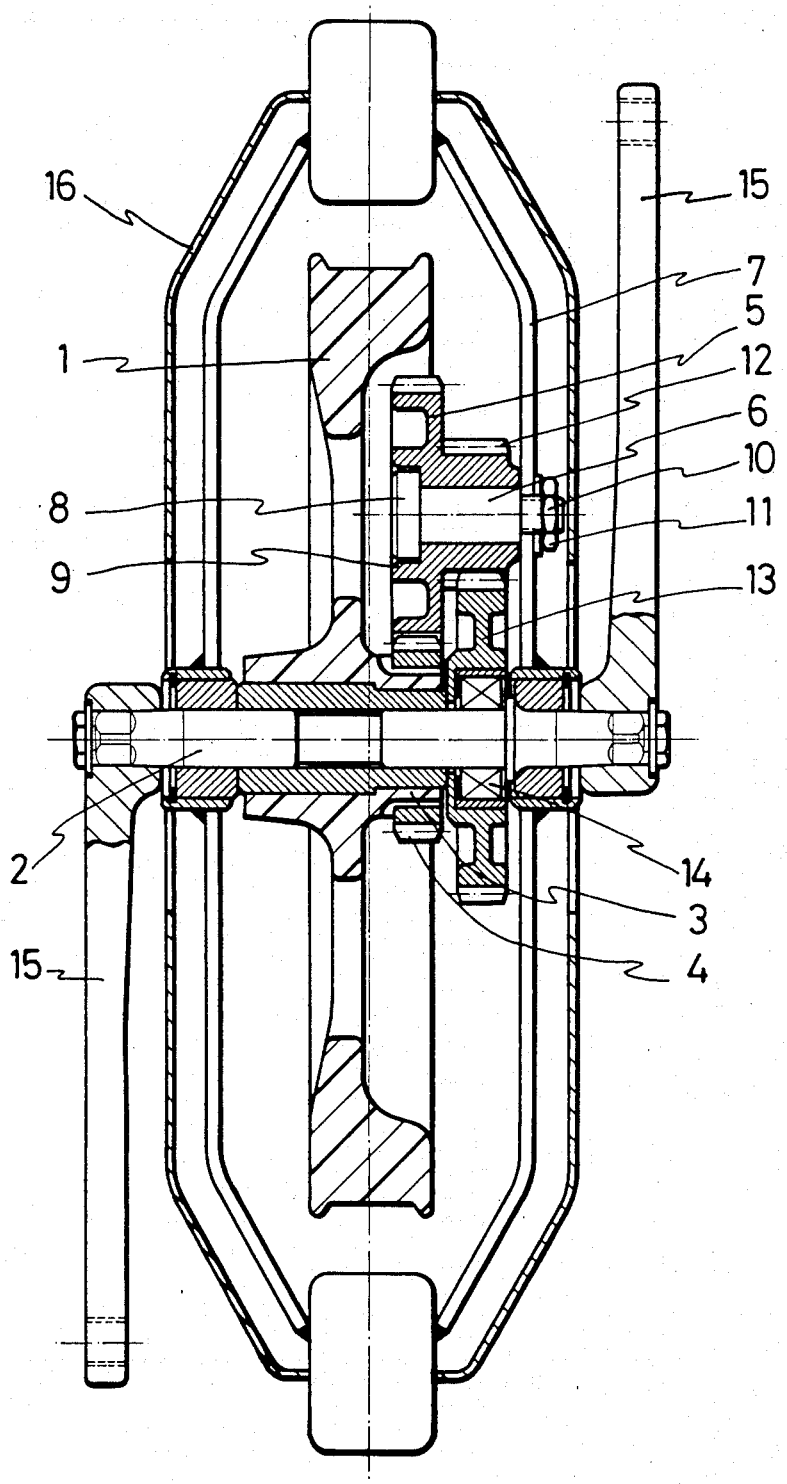
16
15
7
5
1
12
6
10
8
11
9
13
2
14
3
15
4

INERTIA MECHANISM IN GYMNASTIC BICYCLES OR THE LIKE

BACKGROUND OF THE INVENTION

The present invention relates to improvements in mechanisms of inertia for gymnastic bicycles or the like. Such mechanisms have been utilized to afford a degree of inertia capable of absorbing sudden irregularities in the pedalling of the bicycle by the user. A significant decrease in volume is achieved with this degree of inertia by using an inertia flywheel of small diameter and reduced weight, but having an optimum operative performance.

As known, gymnastic bicycles, are provided with an inertia flywheel which serves to absorb sudden irregularities in pedalling.

Conventionally, the inertia flywheel of gymnastic bicycles, whether directly coupled to the axis of the pedal, or mounted on an auxiliary axle, is, as a constant feature, of considerable weight and diameter, wherefore it affords a considerable force of inertia against sudden accelerations or decelerations.

Due to their volume, such inertia flywheels, take up a considerable amount of space and require the provision of a housing frame of large dimensions on the gymnastic bicycle, to which must be added the significant increase in weight which the flywheel adds to the bicycle as a whole.

Thus, both for aesthetic reasons and for reasons of weight, it would be desireable for the inertia flywheel to be of considerably smaller dimensions.

SUMMARY OF THE INVENTION

It is an object of the present invention to provide an inertia mechanism which would allow the use of an inertia flywheel of reduced diameter and weight, without detrimental effect on its operative performance.

This and other objects of the invention are attained by the provision of an inertia flywheel of reduced diameter and low weight mounted on the pedalling axis and provided with a cogged crown by means of which it is connected to a set of gears, such that when the inertia flywheel is dragged by the pedalling axle, the latter must simultaneously drag therewith the set of gears, which results in an effect of inertia similar to that achieved with an isolated inertia flywheel of considerably larger dimensions and weight.

As a complement to the structure described, and as a further characteristic of the invention, it has been foreseen that the gears forming the mentioned set are helical in shape, i.e., the cogs are inclined to avoid the problems of noise which a set of gears having straight cogs would generate.

BRIEF DESCRIPTION OF THE DRAWINGS

In order to complete the description being made, and to a single FIGURE of the drawing illustrates a diametrical cross-section of the pedalling axle of a gymnastic bicycle provided with the inertia mechanism which constitutes the present invention.

DETAILED DESCRIPTION OF THE PREFERRED EMBODIMENT

An inertia mechanism according to the invention includes an inertia flywheel 1, of reduced weight and dimensions, mounted on a pedalling axle 2 of the bicycle, which inertia flywheel has a cylindrical neck 3, on which is arranged a cogged crown 4, which crown meshes with a further cogged crown 5 mounted on and capable of rotating freely about an axle 6 which is fixed to the support framework 7 of the pedalling axle itself, wherefore axle 6 is provided with an expanded head 8 designed to fit into an axial housing 9 provided in cogged crown 5, and a threaded rod 10 which crosses an aperture provided in framework 7, and allows a coupling thereof with the aid of a nut 11.

The cogged crown 5, which is of a larger diameter and has a greater number of cogs than those of cogged crown 4, is integral with a second cogged crown 12, of a smaller diameter and smaller number of cogs, which meshes in turn with a pinion 13, mounted on pedalling axle 2 and being capable of rotating freely by means of a bearing 14.

Likewise in accordance with a preferred embodiment of the invention, gears or crowns 4, 5, 12 and 13 are preferably made of plastic, although it is obvious that they may be of any other suitable material.

In accordance with a further characteristic of the invention, all the gears are helical in shape, i.e., the cogs are inclined in order to avoid noise generation.

It can be inferred from the structure described that the small inertia flywheel is dragged on actuating the pedals, and pedalling axis 2 through connecting rods 15, but the set of gears or cogged crowns must likewise be dragged along, and thus the inertia defined for flywheel 1 is similar, to that afforded by a conventional flywheel of considerably large diameter and weight, this entailing a substantial reduction in the overall weight of the gymnastic bicycle, a significant reduction in the price of the materials constituting the inertia mechanism, especially when the set of gears is made of plastic, and a substantial reduction in the volume of a frame 16 which covers and protects such mechanism, which in turn affords a substantial improvement to the appearance of the gymnastic bicycle as a whole.

The materials, shape, size and arrangement of the materials may vary, provided such variations does not imply a modification in the essentiality of the invention.

There has been disclosed heretofore the best embodiment of the invention presently contemplated. However, it has to be understood that various changes and modifications may be made thereto without departing from the spirit of the invention.

I claim:

1. Inertia mechanism for a gymnastic bicycle having a pedalling axle, the mechanism comprising an inertia flywheel having a cylindrical neck, a first cogged crown coupled to said cylindrical neck, a second cogged crown meshing with said first cogged crown and being of a larger diameter and having a greater number of cogs than those of said first cogged crown, a support frame enclosing said flywheel, an axle parallel to said pedalling axle and coupled to said support frame, said second cogged crown being mounted on and freely rotatable about said axle, a third cogged crown of a smaller diameter and having a smaller number of cogs than those of said second cogged crown and being integral and coaxial with said second cogged crown, and a pinion meshing with said third cogged crown and being of a greater diameter than that of said third cogged crown, said pinion being mounted on said pedalling axle and being freely rotatable thereon by means of a bearing so that inertia required to set the cogs of said crowns into motion is overcome by actuating the pedalling axle in addition to overcoming the inertia of said flywheel.

2. Inertia mechanism according to claim 1, wherein the cogs of said cogged crowns are made of plastic.

3. Inertia mechanism according to claim 1, wherein said cogs are inclined to avoid noise generation upon the actuation of the mechanism.

* * * * *